US011859323B2

(12) United States Patent
Yamamoto et al.

(10) Patent No.: US 11,859,323 B2
(45) Date of Patent: Jan. 2, 2024

(54) CLOTH, CLOTH PRODUCT AND METHOD FOR PRODUCING THE CLOTH PRODUCT

(71) Applicant: KABUSHIKI KAISHA MIYAKE DESIGN JIMUSHO, Tokyo (JP)

(72) Inventors: Sachiko Yamamoto, Tokyo (JP); Sen Kawahara, Tokyo (JP)

(73) Assignee: KABUSHIKI KAISHA MIYAKE DESIGN JIMUSHO, Tokyo (JP)

( * ) Notice: Subject to any disclaimer, the term of this patent is extended or adjusted under 35 U.S.C. 154(b) by 0 days.

(21) Appl. No.: 17/748,256

(22) Filed: May 19, 2022

(65) Prior Publication Data

US 2022/0275548 A1 Sep. 1, 2022

Related U.S. Application Data

(63) Continuation of application No. 16/547,830, filed on Aug. 22, 2019, now Pat. No. 11,725,316.

(30) Foreign Application Priority Data

Aug. 22, 2018 (JP) ..... 2018-155799

(51) Int. Cl.
*D04B 1/24* (2006.01)
*D04H 3/14* (2012.01)

(52) U.S. Cl.
CPC ..... *D04H 3/14* (2013.01); *D04B 1/24* (2013.01); *D10B 2501/04* (2013.01); *D10B 2501/06* (2013.01)

(58) Field of Classification Search
None
See application file for complete search history.

(56) References Cited

U.S. PATENT DOCUMENTS

2012/0279260 A1* 11/2012 Dua ..... D04B 21/08 66/171
2013/0108831 A1 5/2013 Wu et al.

FOREIGN PATENT DOCUMENTS

| | | | |
|---|---|---|---|
| JP | 2008007625 | * | 1/2008 |
| JP | 2008-150749 | A | 7/2008 |
| JP | 2011-106074 | A | 6/2011 |
| JP | 2016-160546 | A | 9/2016 |

OTHER PUBLICATIONS

Machine Translation of JP2008007625 (Year: 2008).*
Machine English translation of JP2016160546, Osamu st al. (Year: 2016).
Machine English translation of JP2011106074 (Year: 2011).

* cited by examiner

*Primary Examiner* — Shawn Mckinnon
(74) *Attorney, Agent, or Firm* — WHDA, LLP

(57) ABSTRACT

The present invention provides a cloth having different properties depending on regions, a cloth product comprising the cloth, and a method of producing the cloth product. The cloth of the present invention is characterized in that it includes a first region and a second region having a higher degree of fusion than the first region, wherein the first region includes a thermally fusible fiber and a fiber having a higher melting point than the thermally fusible fiber at a predetermined ratio. The cloth product of the present invention is characterized in that it includes the body made of the cloth, and the second region is positioned in a region requiring a greater strength than other regions.

6 Claims, 7 Drawing Sheets

Front body

Back body

Front body

Back body

CLOTH, CLOTH PRODUCT AND METHOD FOR PRODUCING THE CLOTH PRODUCT

CROSS REFERENCE TO RELATED APPLICATIONS

This application is a Continuation of U.S. patent application Ser. No. 16/547,830, filed Aug. 22, 2019, which claims the benefit of Japanese Patent Application No. 2018-155799 filed in the Japan Patent Office on Aug. 22, 2018, which is incorporated by reference herein in its entirety.

TECHNICAL FIELD

The present invention relates to cloth, cloth product and a method of producing the cloth product.

BACKGROUND OF THE INVENTION

As to a clothing including a cloth composed of thermally fusible yarns and other yarns, a technique is known in which the thermally fusible yarn is fused or melted by heat-setting processing to provide, for example, an anti-fray function to the cloth (for example, Patent Document 1).

PRIOR ART

Patent Document

[Patent Document 1] Japanese Unexamined Patent Application Publication No. 2008-150749

SUMMARY OF THE INVENTION

Problem to be Solved by the Invention

Since the above heat-setting process is performed over the entire surface of the cloth, the processed single cloth has substantially uniform properties over the entire surface area. Unfortunately, this fact greatly limits the use or application of a single piece of cloth. That is, even if such a single cloth is used, a cloth product having a variety of designs cannot be obtained.

It is therefore an object of the present invention to provide a cloth having different properties, such as strength, hardness, texture, etc., in different regions, a cloth product comprising the cloth, and a method for producing the cloth product, in order to make it possible to provide a highly designed cloth product having a variety of designs.

Means to Solve the Problems

In order to solve the above-mentioned problems, the present invention provides a cloth including a thermally fusible fibers and fibers having a higher melting point than the thermally fusible fibers in a predetermined ratio thereof, wherein the cloth has a first region and a second region having a higher degree of fusion than the first region. The "cloth" in the present invention is referred to also as textile and includes woven or non-woven fabric and knitted fabric in the technical conception. Here, it is preferable that the thermally fusible fiber is composed of a core portion and a sheath portion and that the sheath is made of a resin having a melting point lower than that of the core portion and covers the outer periphery of the core portion.

The cloth of the present invention can be produced by a method for producing a cloth, comprising the steps of;

providing a cloth comprising thermally fusible fibers and fibers having a higher melting point than the thermally fusible fibers at a predetermined ratio thereof (providing or preparing step), and heating a predetermined region of the cloth to increase the degree of thermal fusion thereof compared to other regions (thermal fusion step). Also in this method, it is preferable that the thermal fusion fiber is composed of a core portion and a sheath portion and that the sheath portion is made of a resin having a melting point lower than that of the core portion and covers the outer periphery of the core portion.

According to the cloth and the method of producing the cloth of the present invention having such a configuration, since the degree of fusion (in other words, melt or fusion bonding or welding) is different in the first region and the second region, it is possible to provide a single cloth having different properties depending on the region.

In the method of producing a cloth of the present invention described above, it is preferable that the predetermined region of the cloth is heated (heat-pressed) while the other regions are masked. Additionally or alternatively, it is preferred that in the thermal fusion step, the predetermined region of the cloth is heated while the other regions are folded on an opposite side of a surface to be thermally fused in the predetermined region.

According to the method of producing a cloth of the present invention having such a configuration, for example, a heat press machine or a heat setter may be used for the thermal fusion, and in particular, a special tool such as a die is not required, so that the thermal fusion can be easily carried out.

The present invention also provides a cloth product comprising the above cloth (i.e. a body comprising the above cloth), wherein the second region is positioned in a region requiring greater strength than other regions. Here, cloth products include, for example, bag and clothing.

For example, when the cloth product is a bag, it is preferable that the second region is a portion located on the outer surface. When the cloth product is clothing, it is preferable that the second region is a portion corresponding to at least one of a collar, a body side portion (a boundary portion between a front body and a back body), a yoke, a pocket, a skirt, a front stand, a front end, a tab, a belt, and a belt loop. In other words, these portions are heat-set by the thermal fusion to form (three-dimensional) structural arrangements (shapes) in the respective cloth products, providing morphological stability, dimensional stability, and texture (feel, touch) fixation.

It is preferable that the method for producing a cloth of the present invention further includes a dyeing step for dyeing the cloth and/or a drying step for drying the cloth, at a temperature lower than the melting point of the thermally fusible fiber.

The present invention further provides a method of producing a cloth product from the cloth of the present invention described above. The method of producing a cloth product includes the method of producing a cloth of the present invention, comprising the steps of; providing a cloth comprising thermally fusible fibers and fibers having a higher melting point than the thermally fusible fibers at a predetermined ratio thereof, and heating a predetermined region of the cloth to increase the degree of thermal fusion thereof compared to other regions.

The method of producing a cloth product further includes the steps of: forming a cloth product from the cloth by cutting, sewing, folding or combining to form a precursor (precursor producing step), and heating a predetermined region of the precursor (thermal fusion step). The method may include a thermal fusion step in which a predetermined region of the cloth prepared in the preparation step is heated, and a final process in which a cloth product is formed from the cloth after the thermal fusion step by cutting, sewing, folding or combining.

According to the cloth or cloth product of the present invention having the above-described configuration obtained as described above, various designs can be realized with a smaller number of parts, and the product design is widened.

Effect of the Invention

According to the present invention, it is possible to obtain a cloth having different properties, for example, strength, hardness, texture, and the like, depending on the region. Thus, various forms of cloth products can be made.

DETAILED DESCRIPTION OF THE INVENTION

Hereinafter, typical embodiments of the present invention will be described in detail with reference to the drawings. Note that, since the drawings are for conceptually explaining the present invention, the dimensions, ratios, or numbers may be exaggerated or simplified as necessary for easy understanding, and the present invention is not limited to these.

1. Cloth Used in Embodiments of the Present Invention

First, the cloth 1 used in the embodiment of the present invention will be described. Although a knitted fabric is described as an example of the cloth 1, a woven fabric or a non-woven fabric may be used as the cloth 1. In other words, the present invention can be applied to cloths including fabrics and textiles in general.

Figure 1A:
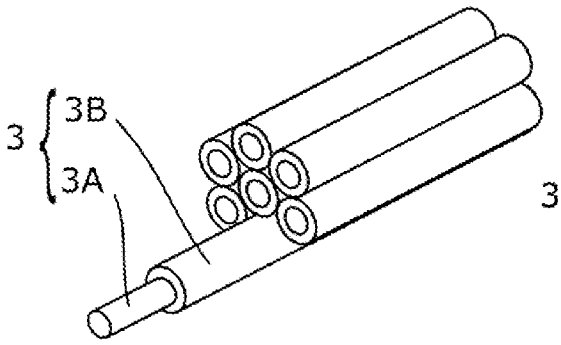
FIGS. 1(A) and 1(B) are schematic views of a thermally fusible fiber (thermally fusible yarn) 3 used in an embodiment of the present invention.
Figure 2:
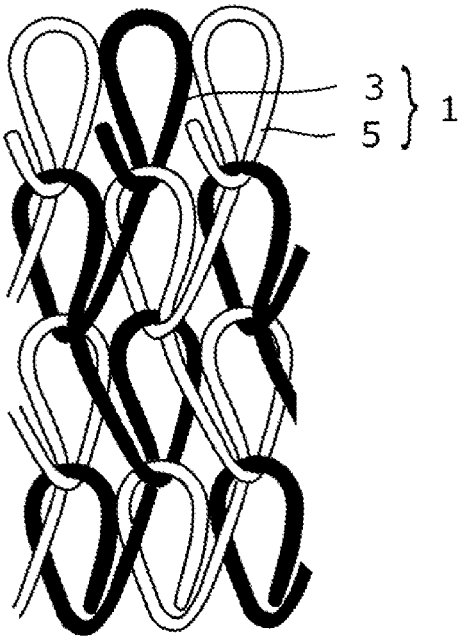
FIG. 2 is a view showing an example of a cloth 1 in which thermally fusible fibers (thermally fusible yarns) 3 are knitted.

The cloth 1 includes, for example, as shown in FIG. 2, a predetermined ratio of thermally fusible fibers (thermally fusible yarns) 3 and other fibers (other yarns) 5 having a higher melting point than the thermally fusible fibers 3. The mixing ratio of the thermally fusible fibers 3 and the other fibers 5 will be described later. First, the structure and composition of the thermally fusible fiber 3 will be described. As shown in FIG. 1(A), the thermally fusible fiber 3 is a composite filament having a core-sheath structure composed of a core portion 3A and a sheath portion 3B. The sheath portion 3B is made of a resin having a melting point lower than that of the core portion 3A, and covers the outer periphery of the core portion 3A.

Figure 1B:
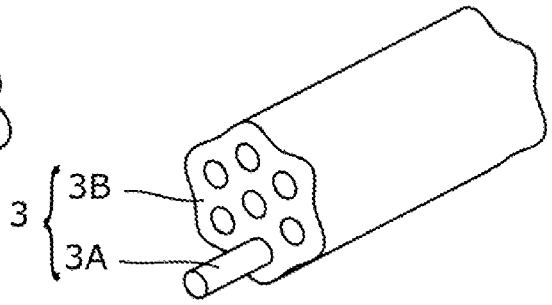

When the sheath 3B is cooled after fusion or melt by heating, the thermally fusible fibers 3 adhere to each other or to other fibers to be bonded (fixed), as illustrated in FIG. 1(B). By such thermal fusion, the thermally fusible fiber 3 can retain its strength even after the fusion bonding.

In order to function as the thermally fusible fiber 3, the sheath 3B preferably has a melting point lower than the melting point of the core 3A by 20° C. or more, and more preferably by 30° C. or more. That is, the melting point of the sheath 3B is lower than the melting point of the core 3A at least by 20° C., and more preferably at least by 30° C.

Since the thermally fusible fiber 3 of the embodiment of the present invention has a core-sheath structure, it is generally produced by a melt spinning method. The core component constituting the core portion 3A is polyester, and the sheath component constituting the sheath portion 3B is a low melting point polyester.

Therefore, the polyester as the core component is not particularly limited as long as the effect of the present invention is not impaired, and may have a composition that does not deteriorate melt spinning operability with the sheath component, and may be, for example, a homopolyester or a copolymerized polyester. The melting point of the core component may be 210° C. or more, and more preferably 220° C. or more, for example, when the melting point of the low melting polyester is 190° C. As the material of the core 3A, other types of polyester may be employed, or resins other than polyester may be employed.

When the core component is a copolymerized polyester, in order to improve the strength of the thermally fusible monofilament, it is preferable that its intrinsic viscosity is in the high viscosity range of 0.66 to 0.90, in particular, the intrinsic viscosity is in the high viscosity range of 0.68 to 0.85. Among them, it is most preferable to use high viscosity PET (polyethylene terephthalate) having an intrinsic viscosity of 0.68 to 0.85.

The low melting point polyester, which is a sheath component constituting the sheath 3B, is not particularly limited as long as it does not impair the effects of the present invention, and may have a melting point lower than that of the polyester of the core component of the present invention by 20° C. or more, preferably 30° C. or more. For example, copolymerized polyesters obtained by copolymerizing isophthalic acid, adipic acid, 1,4-butanediol, and the like can be exemplified. Among them, polyester obtained by copolymerizing isophthalic acid is preferable, and PET obtained by copolymerizing isophthalic acid is particularly preferable. When isophthalic acid copolymerized PET is used, it is preferable to copolymerize 20 to 40 mol % with respect to the sheath component from the viewpoint of spinning operability and cost.

Suitable combinations of the core component and the sheath component include a combination of homo-PET and isophthalic acid copolymerized PET, a combination of high viscosity copolymerized PET and isophthalic acid copolymerized PET, and the like. Among them, the combination of the high viscosity copolymerized PET and the isophthalic acid copolymerized PET is more preferable in that the strength of the fiber or yarn can be sufficiently maintained. As the material of the sheath 3B, other types of polyester may be used, or resins other than polyester may be used.

In an embodiment of the present invention, the melting point of the sheath component, a low melting point polyester, is 190° C. By subjecting the thermally fusible fibers 3 to heat processing, the low melting point polyester constituting the sheath 3B is fused or melted to form monofilament (single yarn) from multifilament as shown in FIG. 1(B), for example.

The fineness of the thermally fusible fiber 3 having such a composition can be appropriately selected according to the desired properties such as strength, hardness, and texture of a cloth or a cloth product, and may be, for example, in the range of 20 to 300 dT (decitex). In addition, it is preferable that the thermal shrinkage ratio of the thermally fusible fibers 3 is 10% or less so that the cloth or the cloth product is not excessively shrunk and distorted when heat-set is carried out by heating process such as heat pressing.

As a specific example of the above-mentioned thermally fusible fiber 3, there is a low melting point core-sheath structure filament available under the trade name (registered trademark) of "Bellcouple" by KB Seiren Co., Ltd.

Next, other fiber (other yarn) 5 to be blended into the cloth 1 will be described. The other fiber 5 is made of a resin such as polyester, for example. In the present embodiment, the polyester used as the other fiber 5 has a melting point higher than the melting point of the low melting point polyester constituting the sheath component of the sheath 3B of the thermally fusible fiber 3. The polyesters of the other fibers 5 may be the same as the core components of the core 3A of the thermal fusion fibers 3 above-mentioned above.

Furthermore, the fineness of the polyester constituting the other fiber 5 may be in the range of, for example, 20 to 300 dT (decitex), and the melting point of the polyester constituting the other fiber 5 is, for example, 210° C. or more, preferably 220° C. or more, and more preferably 225° C. or more. However, the other fibers in the present invention are not limited to the polyester having the above composition, fineness and melting point as long as they have a melting point higher than the melting point of the above-mentioned low melting point polyester. The other fibers may be one type of fibers or a plurality of types of fibers.

In the cloth 1 according to the embodiment of the present invention, it is preferable that in the knitted fabric, for example, as shown in FIG. 2, the thermally fusible fibers (thermally fusible yarns) 3 are knitted uniformly when viewed in terms of cloth piece per unit area. That is, one in several lines per unit area is a thermally fusible fiber (thermally fusible yarn). In addition, it is preferable that the thermally fusible yarn 3 is woven as the warp yarn and/or the weft yarn uniformly in the woven fabric. That is, one in several is a thermally fusible yarn per unit area.

The ratio of the thermally fusible fibers 3 to the other fibers 5 in the cloth 1 may be appropriately set in accordance with properties such as thickness, strength, hardness, etc. required for the cloth product to which the cloth 1 is applied. For example, in an embodiment of the present invention, considering that the cloth 1 is applied to the clothing 10 and the bag 20, the ratio of the number of the thermally fusible fibers 3 to the number of the other fibers 5 is substantially 1:1. When the cloth 1 is a knitted fabric, the one-loop configuration is knitted with thermally fusible fibers 3 and other fibers 5. When the ratio of the thermally fusible fibers 3 to the other fibers 5 is expressed in terms of weight, about 40 to 80% by weight of the cloth 1 is the thermally fusible fibers 3 and the remaining is other fibers 5 (total 100% by weight). However, the present invention is not limited to this ratio.

Incidentally, when the low melting point polyester, which is a sheath component included in the thermal fusion yarn 3, is knitted or folded into the cloth 1, the low melting point polyester starts thermal fusion or melting at a temperature lower than the set melting point of the thermal fusion yarn 3. The inventors have found that in the case of the thermal fusion yarn 3 having a melting point of, for example, 190° C., the sheath 3B starts to fuse or melt at 120° C. to 130° C., and the sheath 3B starts to fuse or melt to a greater degree when the heat processing temperature exceeds 150° C. Here, the temperatures of 130° C. and 150° C. correspond to the temperatures in the dyeing step and the subsequent drying step of the cloth 1, respectively.

The cloth 1 containing the thermally fusible yarn 3 in a proportion of about 50 to 70% by weight as in the embodiment of the present invention is not so hard, but the cloth 1 containing the thermally fusible yarn 3 in a proportion of 100% by weight hardens remarkably after the dyeing step and the drying step. Regardless of the ratio of the thermally fusible yarns 3, when the heating temperature reaches 190° C., the sheath 3B is almost completely fused or melted, and the cloth 1 becomes the hardest state that is supposed to be.

Therefore, in an embodiment of the present invention, the above-described properties of the thermally fusible yarn 3 are utilized to cure or harden certain areas of the cloth 1 more than other areas. In other words, the cloth 1 containing the thermally fusible fibers 3 at a predetermined ratio is prepared, and heat processing is carried out on a predetermined region (second region) of the cloth 1, thereby increasing the degree of fusion of the sheath portion 3B more than other regions (first region). The cloth 1 thus produced consequently has a region (first region) in which the degree of fusion of the sheath 3B is relatively low and a region (second region) in which the degree of fusion of the sheath 3B is relatively high.

Here, the method of the heating can be changed depending on the degree of curing or hardening required, the thickness of the cloth 1, the type of the intended cloth product, and the like. For example, when the clothing 10 is produced as in Embodiment 1 described later, the cloth 1 may be heat-pressed while being partially covered with a thick felt. According to this method, the exposed portion of the cloth 1 can be cured by heat, and at the same time, curing of the remaining portion can be inhibited. Since this method can easily prepare tools, the initial cost is low, and it can cope with a variety of products and a small-volume production.

Further, in the case of producing the bag 20 as in Embodiment 2 described later, it is also possible to cure only a desired region by folding the cloth 1 and pressing the cloth 1 while the desired region is positioned on the front surface. This method also requires no additional equipment for pressing and can be easily prepared, so that the initial cost is low, and it can cope with a variety of products and low-volume production. Note that each of the above-described heating processes can be performed alone or in combination.

When the jersey cloth (knitted fabric) including the thermally fusible yarn 3 is heated as described above, the heated portion has a texture like a woven fabric. As a result, in the single cloth 1, there are a region (not heat-processed region)

having the followability or flexibility as in the jersey fabric and a region (heat-processed region) having the stable shape, and the availability of the cloth 1 is expanded.

Incidentally, the cloth may be subjected to a dyeing step prior to the heat processing, and the dyeing step is carried out, for example, as follows. As a pretreatment, it is preferable to carry out washing using water or a surfactant to remove oil content and dirt from the cloth.

In the dyeing step, a method of passing the cloth through a dyeing bath may be employed, and various dyeing machines such as a Wins dyeing machine and a liquid flow dyeing machine may be used as the dyeing machine.

A variety of dyes can be used for dyeing, and the type thereof is not particularly limited, but a disperse dye is preferable from the viewpoint of dyeability to polyester fibers. As the disperse dye, for example, an azo or anthraquinone dye can be used.

When a disperse dye is used, a leveling agent, a dispersant, and a pH adjusting agent may be added to the dyeing bath individually or in combination. As the leveling agent, for example, a nonionic leveling agent (for example, an alkylphenol oxidized ethylene additive type) or a special anionic leveling agent (for example, an ether type nonionic sulfuric acid ester type) may be used. As the dispersant, for example, an anionic dispersant (for example, a formalin condensation product of sodium aromatic sulfonate) may be used.

The dyeing bath is then heated to about 130° C. under a high pressure and the cloth is immersed in the dyeing bath at about 130° C. for about 30 minutes. Thereafter, as a post-treatment, reduction washing is carried out to remove unfixed dye and contamination adhering to the cloth, and then the cloth is dried. Drying may be accomplished, for example, by placing the cloth in an atmosphere at about 160° C.

Here, it is preferable that each step of the method of producing a cloth or a cloth product of the present invention satisfies the following relational expressions (1) and (2) relating to temperature conditions.

$$T1<T3<T5 \quad (1)$$

$$T2<T3<T5 \quad (2)$$

wherein, T1 is the dyeing temperature of the cloth, T2 is the drying temperature of cloth, T3 is the melting point of the thermally fusible fiber 3 constituting the cloth, T5 is the melting point of the other fibers 5 constituting the cloth, and the units of T1, T2, T3 and T5 are ° C.

By producing a cloth or a cloth product in a step satisfying the above-mentioned temperature condition, a core material is not separately required to form a frame as a cloth product, and therefore, the width of the product design can be widened.

Hereinafter, a clothing and a bag will be given as examples of cloth products using the cloth 1 as a material. However, the cloth according to the present invention is not limited to the clothing and the bag but can be applied to all of cloth products in general.

2. Embodiment 1

Figure 3:
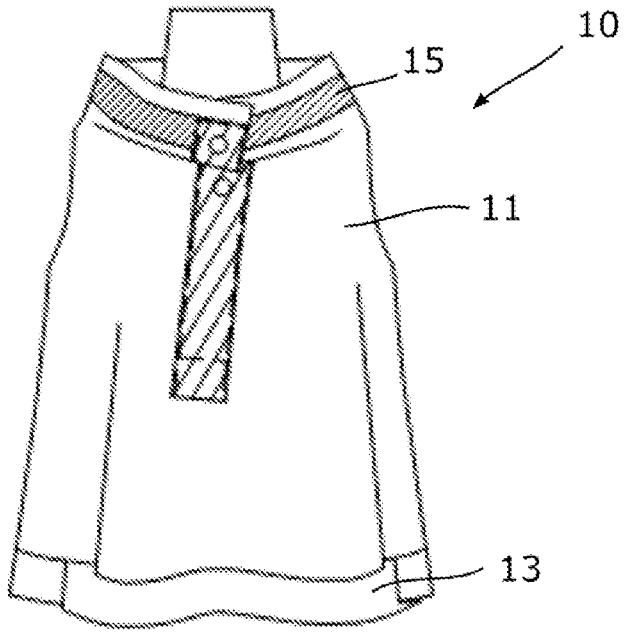
FIG. 3 is a schematic diagram showing an example of the clothing 10 according to the first embodiment.

A clothing 10 according to Embodiment 1 of the present invention will be described. Here, as an example of the clothing 10, a sleeveless shirt as shown in FIG. 3 is taken up. However, the present invention is also applicable to other types of clothing, such as jackets, one-piece dress, pants, trousers, etc.

The clothing 10 according to the first embodiment includes a front body 11 and a back body 13 as shown in FIG. 3. The clothing 10 has a collar 15 and may further include parts such as buttons and pockets. In the clothing 10, at least the front body 11 and the back body 13 are made of cloth 1. Such a clothing 10 can be produced by the following step.

Figure 4A:
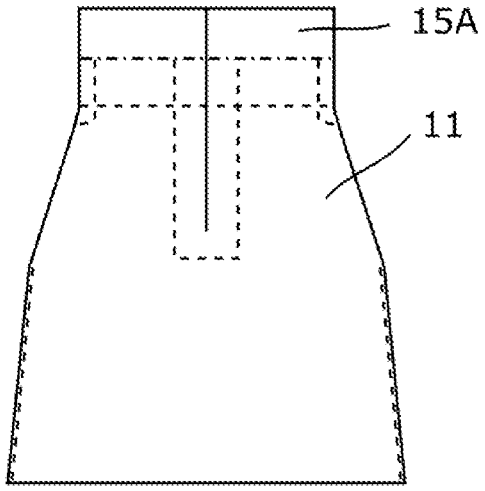
FIGS. 4(A) and 4(B) are exploded views of the cloth 1 constituting the front body 11 and back body 13 bodies of the clothing 10 of FIG. 3.
Figure 4B:
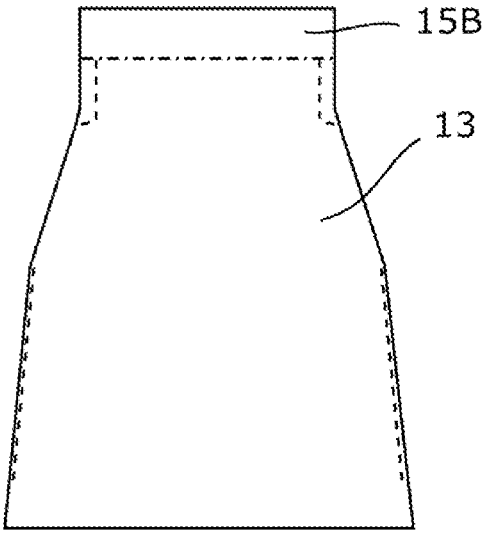

In embodiment 1, knitted fabrics containing 40% to 60% by weight of thermally fusible yarn 3 is used as cloths 1 for the front body 11 and the back body 13 shown in FIGS. 4 (A) and (B). The other yarn 5 other than the thermally fusible yarn 3 is, for example, a polyester fiber such as polyethylene terephthalate. The other yarn 5 may comprises, for example, 84 decitex 48 filaments, 56 decitex 36 filaments, 56 decitex 36 filaments, 84 decitex 36 filaments, 100 decitex 48 filaments or 56 decitex 48 filaments and may have a melting point of, for example, 225° C. The other yarn 5 may be a crimped yarn.

As a knitting method of the cloth 1, for example, jersey knitting is used, and in particular, a single Denbigh stitch (warp knitted fabric) is adopted as shown in FIG. 2. In the single Denbigh stitch, the thermally fusible yarn 3 is employed to form a portion called Denbigh, and this Denbigh is one per unit area. Thus, this type of cloth is thinner and lighter compared to the double Denbigh knitted cloth described in embodiment 2.

After the above-mentioned cloth 1 is prepared, the cloth 1 is cut and the front body 11 and the back body 13 as in FIGS. 4 (A) and (B) are prepared. In FIGS. 4 (A) and (B), the dotted-dashed line indicates a folding line and the broken line indicates a seam, respectively.

Figure 5A:
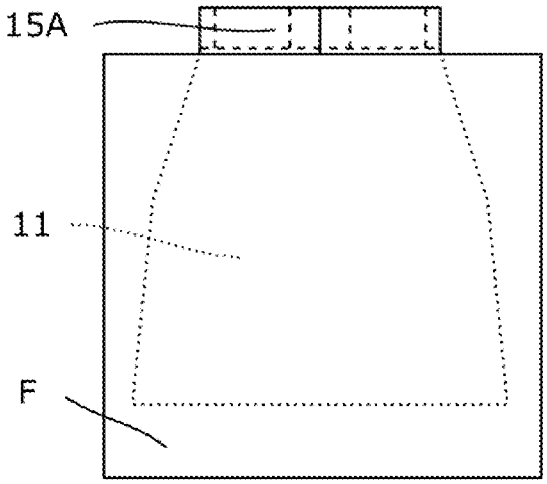
FIGS. 5(A) and 5(B) are explanatory views of a step of thermally fusing the portions 15A and 15B corresponding to the collar portion 15 in the clothing 10 of FIG. 3.
Figure 5B:
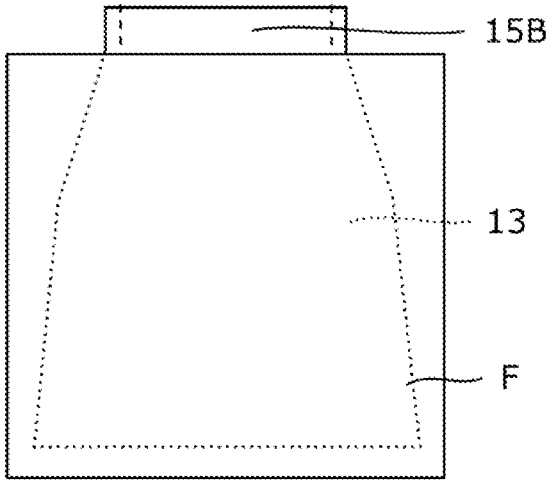

Then, as shown in FIGS. 5 (A) and (B), to expose the portion 15A and 15B corresponding to the collar 15 in FIG. 3, the front body 11 and the back body 13 are masked with a thick felt F. The masking is carried out to prevent the body from being cured and hardened by heating process. At this time, a predetermined portion other than the collar portion 15, for example, a body side portion (a boundary portion between the front body and the back body), a yoke, a pocket, a skirt, a front stand, a front end, a tab, a belt, a belt loop, or the like can be hardened. In this case, masking may be carried out so that the predetermined portion is also exposed.

Then, the front body 11 and the back body 13 covered with the felt F are heat-pressed to cure the portions 15A and 15B corresponding to the collar 15. Thereafter, parts such as facings, buttons, pockets, and the like are sewn if applicable, and the front body 11 and the back body 13 are further sewn to complete the clothing 10 as shown in FIG. 3.

3. Embodiment 2

Next, the bag 20 according to the second embodiment of the present invention will be described. Here, a tote bag as shown in FIG. 6 is taken as an example of the bag 20, but the present invention is also applicable to other types of bags such as, for example, a rucksack.

Figure 6:
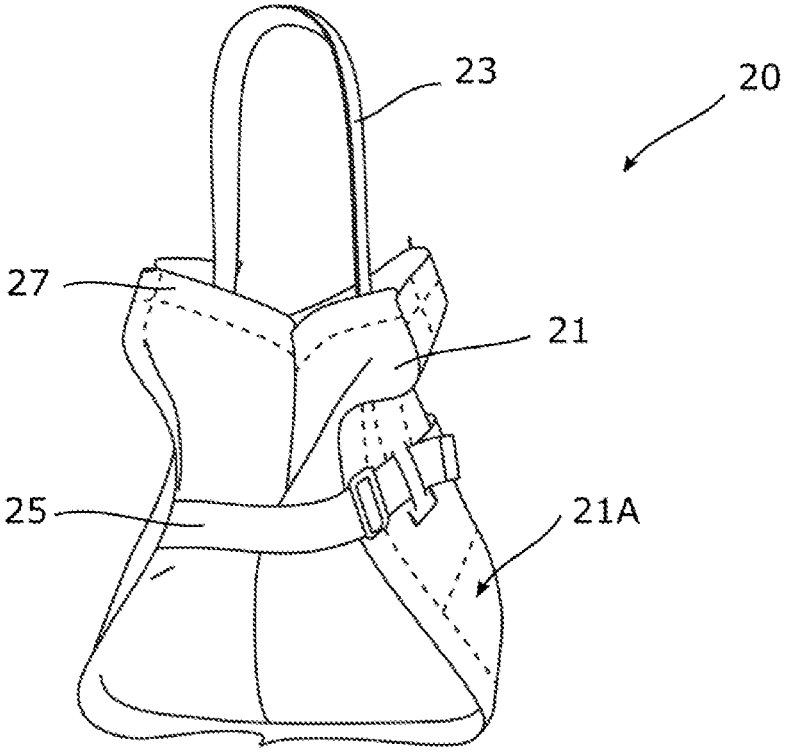
FIG. 6 is a schematic diagram showing an example of the bag 20 according to the second embodiment.

The bag 20 according to the second embodiment includes a main body 21 and a handle 23 as shown in FIG. 6. The bag 20 may also have additional parts, such as inner pockets.

Figure 7:
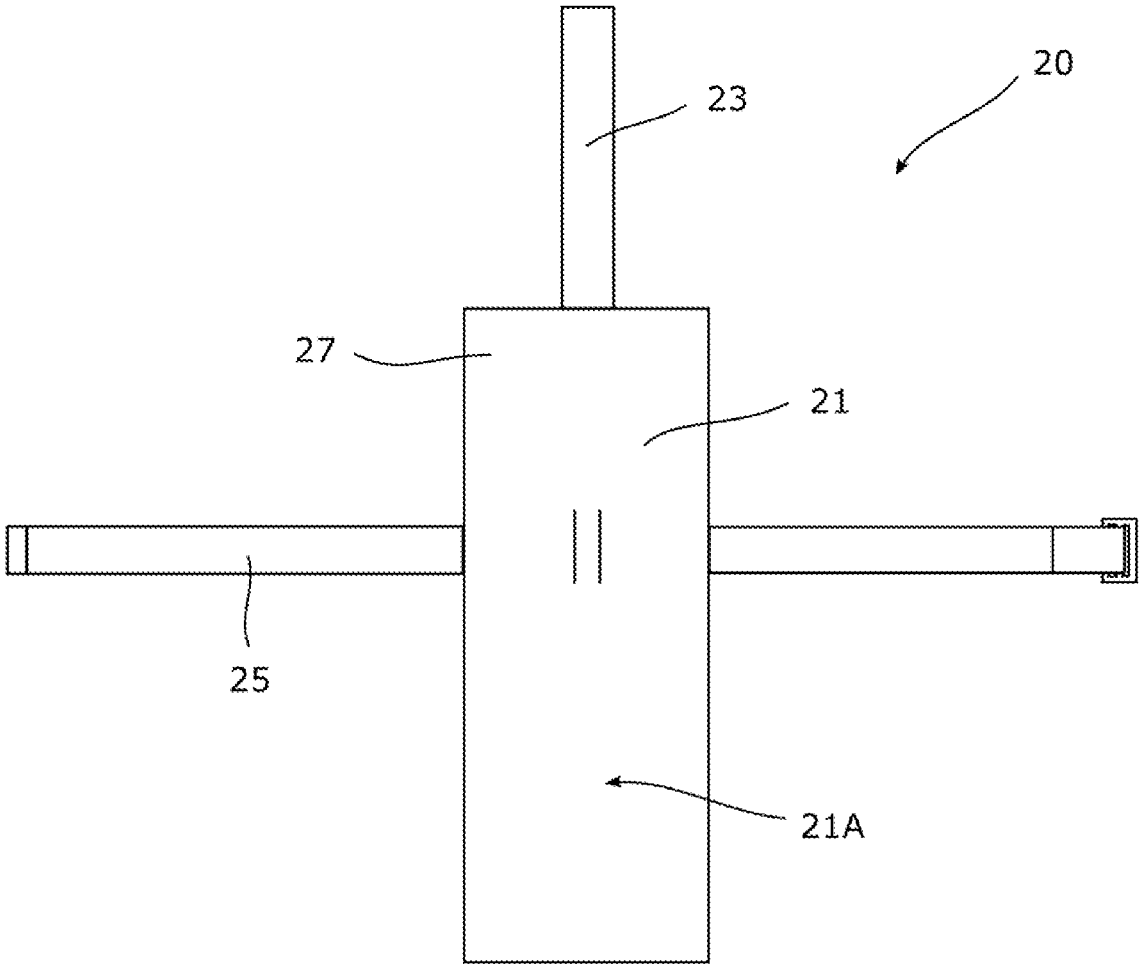
FIG. 7 shows the bag 20 of FIG. 6 in a folded state.

When used for storing an object, the bag 20 can hold the form of a container as shown in FIG. 6. On the contrary, when any object is not stored, the bag 20 can be folded as shown in FIG. 7 to be compactly carried. At least the main body 21 of the bag 20 is made of cloth 1. Such a bag 20 can be produced by the following step.

In the second embodiment, as the cloth 1 for the body of the bag 20 shown in FIG. 6, a knitted fabric in which 60% by weight to 80% by weight of the thermally fusible yarn 3 is admixed is used. The other yarn 5 other than the thermally fusible yarn 3 is made of, for example, a polyester fiber such as polyethylene terephthalate. The other yarn 5 may comprises, for example, 84 decitex 48 filaments, 56 decitex 36 filaments, 56 decitex 36 filaments, 84 decitex 36 filaments, 100 decitex 48 filaments or 56 decitex 48 filaments and may have a melting point of, for example, 225° C. The other yarn 5 may be a crimped yarn.

Further, as a knitting method of the cloth 1, for example, jersey knitting is used, and in particular, a double Denbigh stitch is adopted. In the double Denbigh stitch, the thermally fusible yarn 3 is employed for the Denbigh, and this Denbigh is twice as large as the single Denbigh stitch. Thus, this type of cloth finishes thicker (heavier) compared to the single Denbigh stitch cloth described in embodiment 1.

Figure 8:
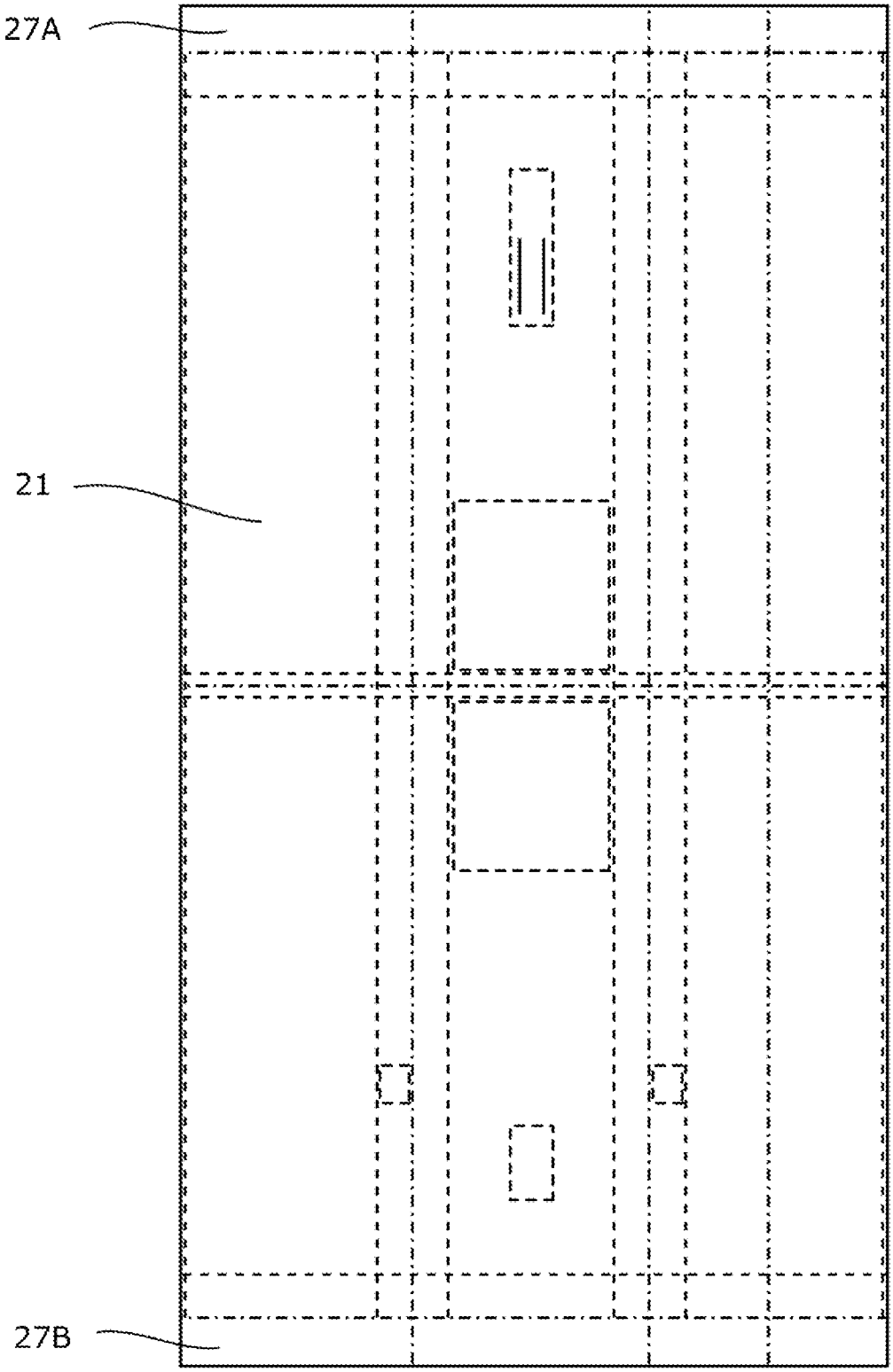
FIG. 8 is an exploded view of the cloth comprising the body of the bag 20 of FIG. 6.

The cloth 1 as described above is prepared for the main body 21 of the bag 20, and the cloth 1 is cut into a substantially rectangular shape as shown in FIG. 8. Here, in FIG. 8, a dotted-dashed line indicates a folding line, and a broken line indicates a seam. At the same time, parts such as a handle 23, a belt 25, a bottoming cloth (not shown), and a pocket (not shown) are prepared.

Figure 9:
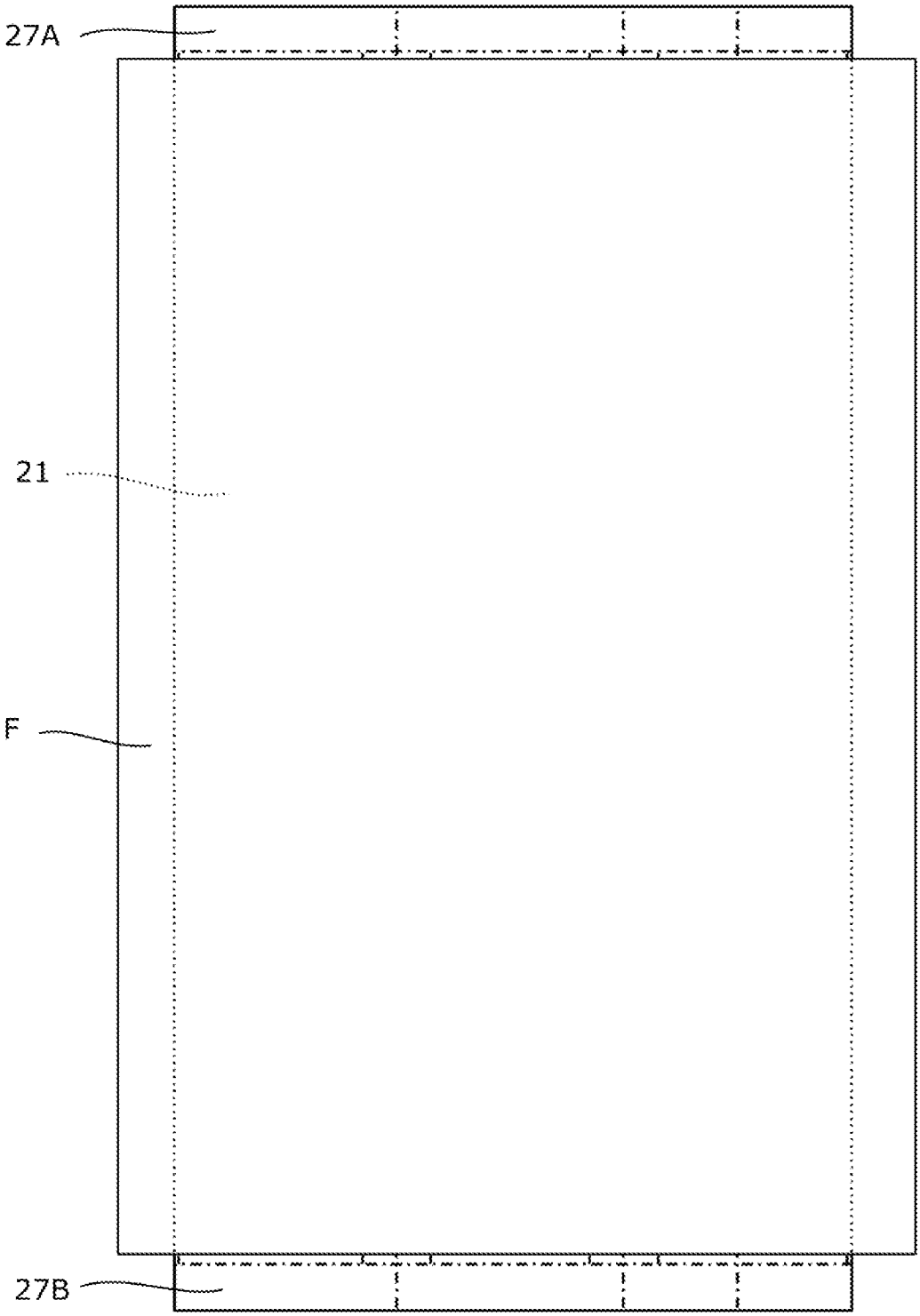
FIG. 9 is an explanatory view of a step of thermally fusing the portions 27A and 27B corresponding to the mouth portion 27 of the bag 20 in the cloth 1 of FIG. 8.

Next, as shown in FIG. 9, the portions 27A and 27B corresponding to the mouth portion 27 of the main body 21 are exposed, and the other portions are covered with the felt F. This is masking for preventing the portion of the main body 21 other than the mouth portion 27 from being cured and hardened by heating.

Then, the portion of the cloth 1 covered with the felt F is heat-pressed, and the portions 27A and 27B corresponding to the mouth portion 27 are cured. In addition, the bottoming cloth (not shown) and the handle 23 may be cured by heating. At this time, the press may be set to have a temperature of, for example, 185° C. for 60 seconds on one side. The pressure of the press may be appropriately set in accordance with a desired degree of curing.

Figure 10:
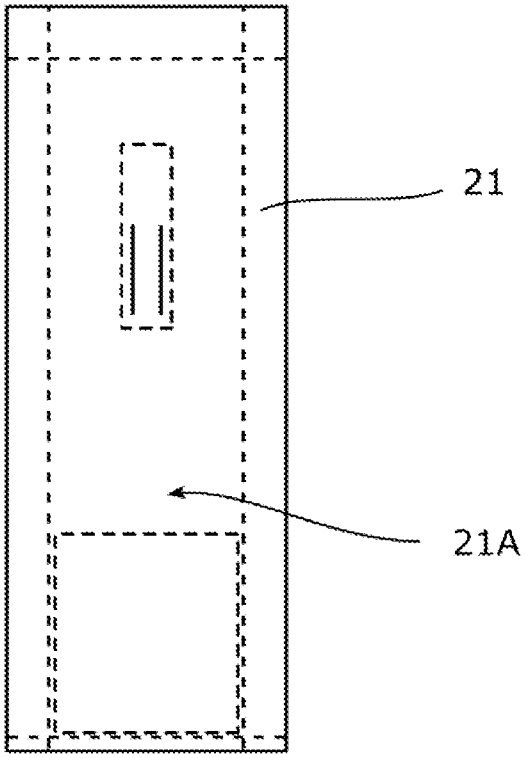
FIG. 10 is an explanatory view of a step of thermally fusing the portion 21A corresponding to the outer surface of the bag 20 in the cloth 1 of FIG. 8.

Next, the main body 21 is pressed with an iron or the like along the dashed-dotted line in FIG. 8 to make folds. Then, other parts such as a bottoming cloth and pockets are sewn to the main body 21, and both sides and the bottom of the main body 21 are sewn. Then, as shown in FIG. 10, the outer surface 21A is formed on the main body 21.

Thereafter, the outer surface 21A of the main body 21 is heat-pressed on both sides to cure the outer surface 21A. At this time, since the portion which is not cured is positioned inside in the previous folding step, it is simply heat-pressed without using the felt F. The press may be set to have a temperature of, for example, 185° C. for 60 seconds. At the time of heat-pressing, in order to eliminate unevenness of the press due to a difference in thickness depending on a portion of the main body 21, it is preferable to carry out the pressing in a state in which thick paper is inserted between the press machine and the main body 21.

After the heating by the press, parts such as the handle 23 and the belt 25 are attached to the main body 21, thereby completing the bag 20.

Although representative embodiments of the present invention have been described above, the present invention is not limited to these, and various design modifications are possible, and all such design modifications are included in the technical scope of the present invention.

For example, as another method for heating process, it is also possible to prepare a molding die having a shape corresponding to a portion to be heated (a mold having a shape of a heating surface) and press the mold on to a portion to be heated. However, this method is suitable for mass production because it takes a considerable cost to produce a molding die. This method can be used alone or in combination with the pressing process with the masked cloth 1 and/or the pressing process with the folded cloth 1.

Further, in the embodiment of the present invention, low melting point polyester is employed as the sheath component of the thermally fusible fiber 3, but it is also possible to use a thermally fusible fiber employing low melting point polyester as the core component. That is, it is possible to produce a cloth by using a thermally fusible fiber in which the melting point of the sheath portion is higher than the melting point of the core portion by a predetermined temperature (e.g., 20° C.) or more, and to produce a cloth product (clothing, bag, etc.) including the cloth.

In the embodiment of the present invention, polyester fibers are used as the other fibers (other yarns) 5, but chemical fibers (for example, nylon fibers) other than polyester fibers or natural fibers can be used. The other fibers (other yarns) 5 may be thermally fusible fibers having a higher melting point than the thermally fusible fibers 3 or thermally fusible fibers having a lower degree of melting.

EXPLANATION OF NUMERALS

1 . . . cloth,
3 . . . Thermally fusible fiber (thermally fusible yarn),
3A . . . Core,
3B . . . sheath,
5 . . . Other fiber (other yarn)
10 . . . Clothing,
15 . . . collar,
20 . . . bag,
21 . . . Main body,
27 . . . mouth,
F . . . Felt.

The invention claimed is:

1. A cloth product comprising a cloth comprising thermally fusible fibers and other fibers having a higher melting point than the thermally fusible fibers at a predetermined ratio thereof, wherein the cloth product has a first region and a second region having a greater degree of fusion than the first region, the thermally fusible fiber comprises a core portion and a sheath portion which covers the outer periphery of the core portion and has a melting point lower than that of the core portion, and the cloth product is a clothing, and the second region is a portion corresponding to at least one of a collar, a body side, a yoke, a pocket, a skirt, a front stand, a front end, a tab, a belt, and a belt loop, said portion being exclusively formed of the second region and the second region is located on at least an outer surface of the cloth product, a content of the thermally fusible fibers is 40 to 60% by weight of the cloth, the cloth is knitted with a single Denbigh stitch, and each of the core portion and the sheath portion is a polyester and the melting point of the sheath portion is lower than that of the core portion by 20° C. or more, and the other fiber is a polyester with a melting point of above 225° C.

2. The cloth product comprising the cloth in accordance with claim 1, wherein the second region is located on both of an outer surface and an inner surface of the cloth product.

3. The cloth product comprising the cloth in accordance with claim 1, wherein the second region is positioned in a region requiring greater strength than other regions.

4. The cloth product comprising the cloth in accordance with claim 1, wherein the core portion of the thermally fusible fiber includes a high viscosity PET (polyethylene terephthalate) having an intrinsic viscosity of 0.68 to 0.85.

5. The cloth product comprising the cloth in accordance with claim 1, wherein the sheathe portion of the thermally fusible fiber includes an isophthalic acid copolymerized PET (polyethylene terephthalate) in an amount of 20 to 40 mol % with respect to the sheath portion.

6. The cloth product comprising the cloth in accordance with claim 1, wherein one loop of the single Denbigh stitch consists of one of the thermally fusible fibers, and another loop, interlocked with the one loop, of the single Denbigh stitch consists of one of the fibers having a higher melting point than the thermally fusible fibers.

* * * * *